US008203268B2

(12) United States Patent
Matsumoto et al.

(10) Patent No.: US 8,203,268 B2
(45) Date of Patent: Jun. 19, 2012

(54) DISCHARGE LAMP WITH A REFLECTIVE MIRROR WITH OPTIMIZED ELECTRODE CONFIGURATION

(75) Inventors: Hideyuki Matsumoto, Yokohama (JP); Takashi Noguchi, Yokohama (JP)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 12/550,426

(22) Filed: Aug. 31, 2009

(65) Prior Publication Data

US 2010/0052496 A1 Mar. 4, 2010

(30) Foreign Application Priority Data

Sep. 1, 2008 (JP) ..... 2008-223391

(51) Int. Cl.
*H01J 1/62* (2006.01)

(52) U.S. Cl. ..... 313/623; 313/626; 313/627; 445/22; 439/226

(58) Field of Classification Search ..... 313/623–627, 313/634–636, 493, 570, 25, 26.3, 318.01–318.12; 318/50; 445/22, 26–27
See application file for complete search history.

(56) References Cited

U.S. PATENT DOCUMENTS

| | | | | |
|---|---|---|---|---|
| 6,211,616 | B1 * | 4/2001 | Takeuti et al. | 313/637 |
| 6,545,430 | B2 * | 4/2003 | Ono et al. | 315/291 |
| 6,597,118 | B2 * | 7/2003 | Arimoto et al. | 315/115 |
| 2003/0020394 | A1 * | 1/2003 | Kitahara et al. | 313/491 |
| 2008/0297739 | A1 * | 12/2008 | Yamauchi et al. | 353/85 |

* cited by examiner

*Primary Examiner* — Tracie Y Green

(57) ABSTRACT

A discharge lamp configured to suppress temperature increases in the electrode on the opening part side of a reflective mirror is described. The discharge lamp includes an F electrode and an R electrode having shapes before forming the melt electrodes that satisfy at least one of the following conditions (a) to (c): (a) The diameter of the core wire of the F electrode is d1*f*, and the diameter of the core wire of the R electrode is d1*r*, then d1*f*>1.2×d1*r*; (b) The wire diameter of the coil of said F electrode is d2*f*, and the wire diameter of the coil of the R electrode is d2*r*, then d2*f*>1.2×d2*r*; (c) the number of windings of the coil of the F electrode is nf, and the number of windings of the coil of the R electrode is nr, then nf>1.2×nr.

16 Claims, 4 Drawing Sheets

DISCHARGE LAMP WITH A REFLECTIVE MIRROR WITH OPTIMIZED ELECTRODE CONFIGURATION

CROSS-REFERENCES TO RELATED APPLICATIONS

This application claims the benefit of Japanese Patent Application No. 2008-223391, filed Sep. 1, 2008.

TECHNICAL FIELD

The present invention relates to a discharge lamp with a reflective mirror that is used in a projector.

BACKGROUND

Currently, an alternating-current (AC) discharge lamp with a reflective mirror (hereinafter, referred to as a lamp), particularly when combined with an elliptical reflective mirror, has an increase in the temperature of the electrode on the opening part side of the elliptical reflective mirror due to the reflected light from the optical system. Consequently, a temperature difference develops between the two electrodes, and the normal halogen cycle no longer functions. As a result, sometimes, the electrode tip on the opening part side of the elliptical reflective mirror erodes, and the lamp characteristics cannot be maintained. In addition, the electrode shape deforms and an offset of the arc spot is produced by the erosion of the electrode. Generally, for an AC high-pressure mercury lamp, spot offset in each cycle gives the impression of "flickering."

As a remedy, PCT Application PCT/IB95/00392 shows a method that adds a pulse superimposed on the current waveform in each cycle, increases the temperature of the electrode tip, and optimizes the halogen cycle. However, in the proposed method, a constant current pulse is always generated, and the halogen cycle is optimized, conversely, substantial damage to the electrode is possible.

SUMMARY OF THE INVENTION

The present invention solves the above problems and provides a discharge lamp with a reflective mirror which suppresses the temperature increase in the electrode on the opening part side of the reflective mirror and has little erosion of the electrode.

The discharge lamp with a reflective mirror related to the present invention comprises a reflective mirror having an opening part and a neck part opposite the opening part, an F electrode welded to an F molybdenum foil which is welded to an F lead wire, an R electrode welded to an R molybdenum foil which is welded to an R lead wire, and a light discharge tube having a roughly spherical light discharge part in the center which seals in mercury, wherein each of the F electrode and the R electrode has a coil having the specified wire diameter and the specified number of windings wound around the end of a core wire having the specified wire diameter, where the core wires are positioned to place the F electrode opposite the R electrode, next, the tips of the F electrode and the R electrode are melted to form melt electrodes having a curved surface, furthermore, electrode tips are formed on the tips of the melt electrodes by aging, and the shapes of the F electrode and the R electrode before forming the melt electrodes satisfy any one of conditions (a) to (c) shown below or any combination of conditions (a) to (c) shown below: (a) let the diameter of the core wire of the F electrode be d1*f*, and the diameter of the core wire of the R electrode be d1*r*, then d1*f*>1.2×d1*r*; (b) let the wire diameter of the coil of the F electrode be d2*f*, and the wire diameter of the coil of the R electrode be d2*r*, then d2*f*>1.2×d2*r*; (c) let the number of windings of the coil of the F electrode be nf, and the number of windings of the coil of the R electrode be nr, then nf>1.2×nr.

In the discharge lamp with a reflective mirror related to the present invention, the surface area of the F electrode can be larger than the surface area of the R electrode, and the temperature increase of the F electrode on the opening part side of the reflective mirror caused by the reflected light from the optical system of the projector can be suppressed by having the shapes of the F electrode and the R electrode before forming the melt electrodes satisfy any one of conditions (a) to (c) shown below or any combination of conditions (a) to (c) shown below. Thus, the halogen cycle functions normally, and the lamp characteristics can be maintained.

(a) Let the diameter of the core wire of the F electrode be d1*f*, and the diameter of the core wire of the R electrode be dir, then d1*f*>1.2×d1*r;*

(b) let the wire diameter of the coil of the F electrode be d2*f*, and the wire diameter of the coil of the R electrode be d2*r*, then d2*f*>1.2×d2*r;*

(c) let the number of windings of the coil of the F electrode be nf, and the number of windings of the coil of the R electrode be nr, then nf>1.2×nr.

DETAILED DESCRIPTION OF ILLUSTRATIVE EMBODIMENTS

Figure 1:
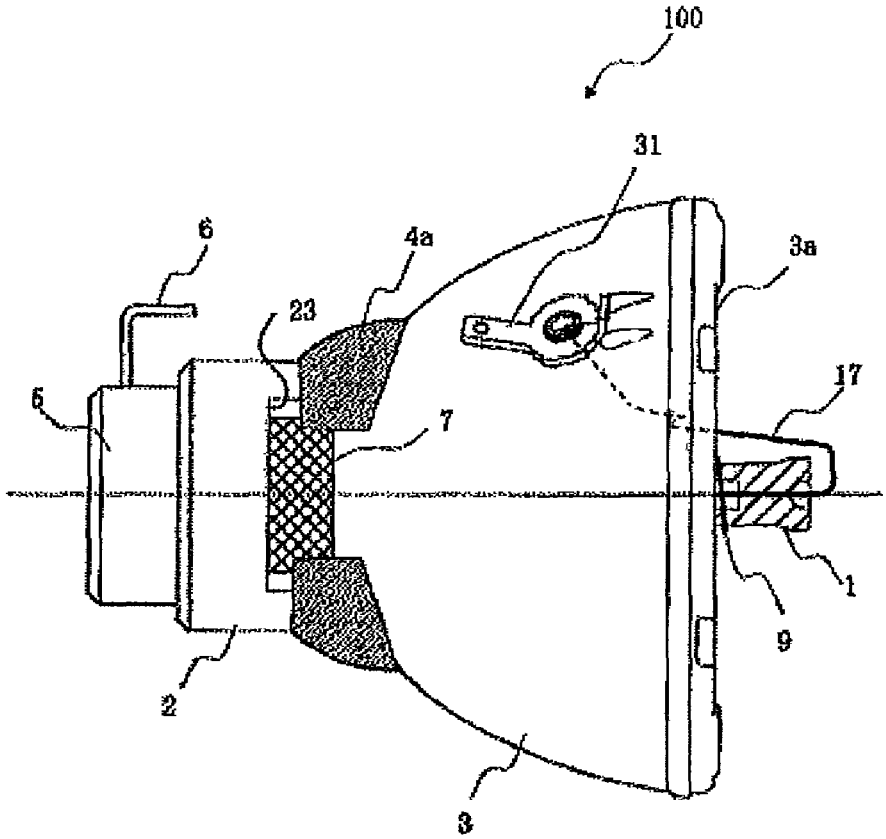
FIG. 1 is a structural diagram of the discharge lamp with a reflective mirror (100) according to an embodiment.
Figure 2:
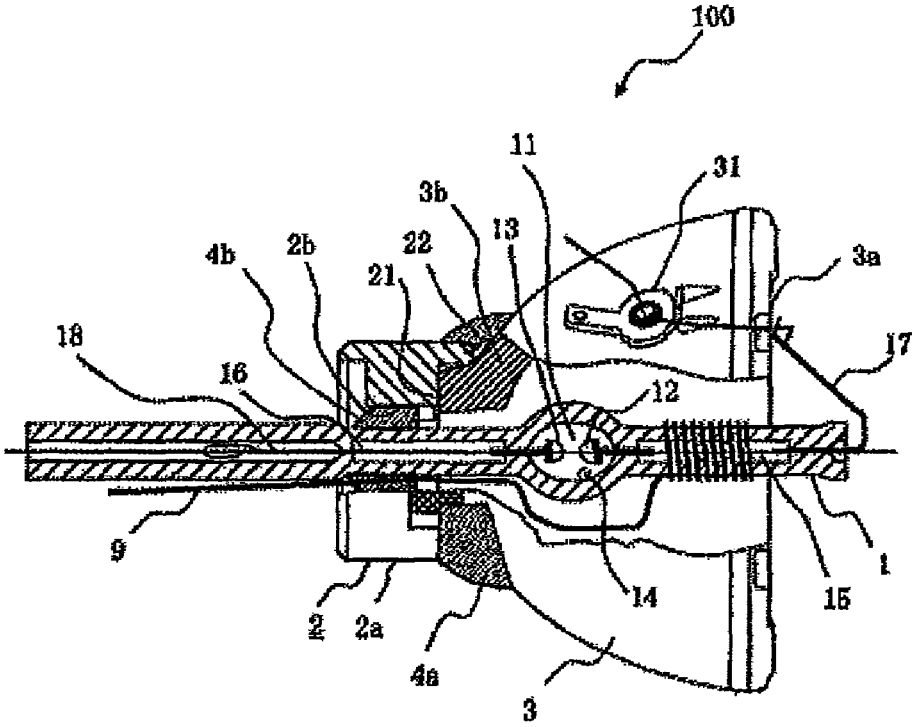
FIG. 2 is a structural diagram of the discharge lamp with a reflective mirror (100) showing the cross section with a portion cut away according to an embodiment.
Figure 3:
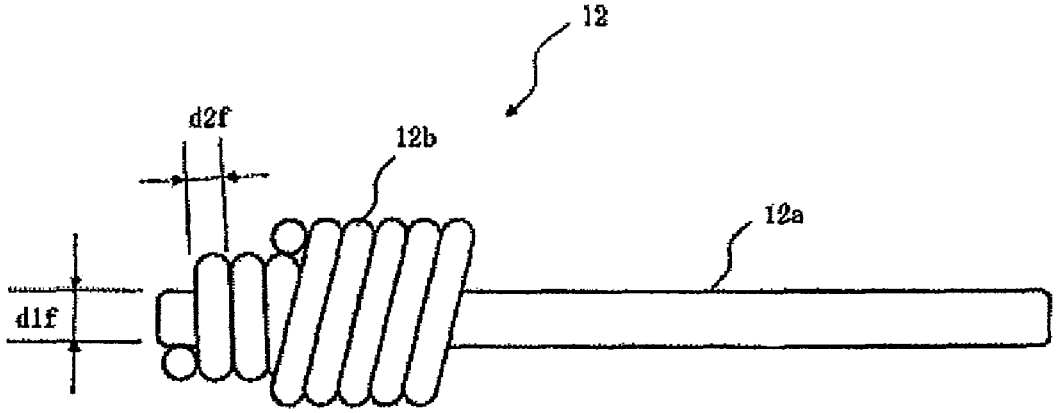
FIG. 3 shows the structure of the F electrode (12) in the initial period of the manufacturing process according to an embodiment.
Figure 4:
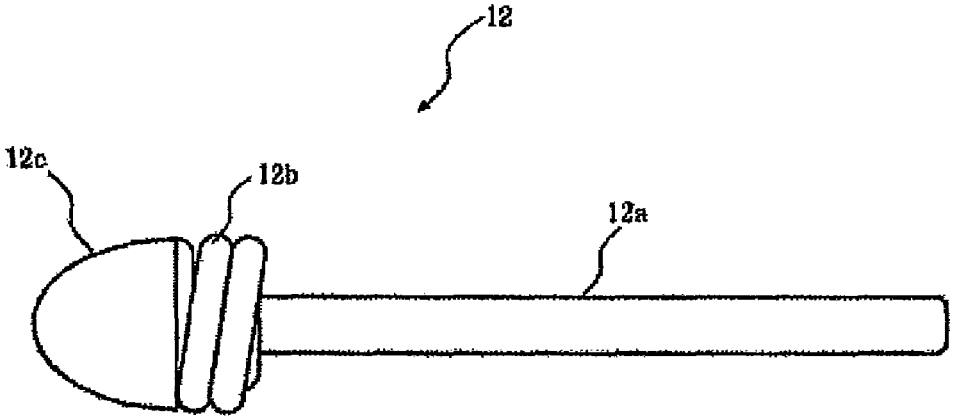
FIG. 4 shows forming the melt electrode (12*c*) by melting the tip of the F electrode (12) according to an embodiment.
Figure 5:
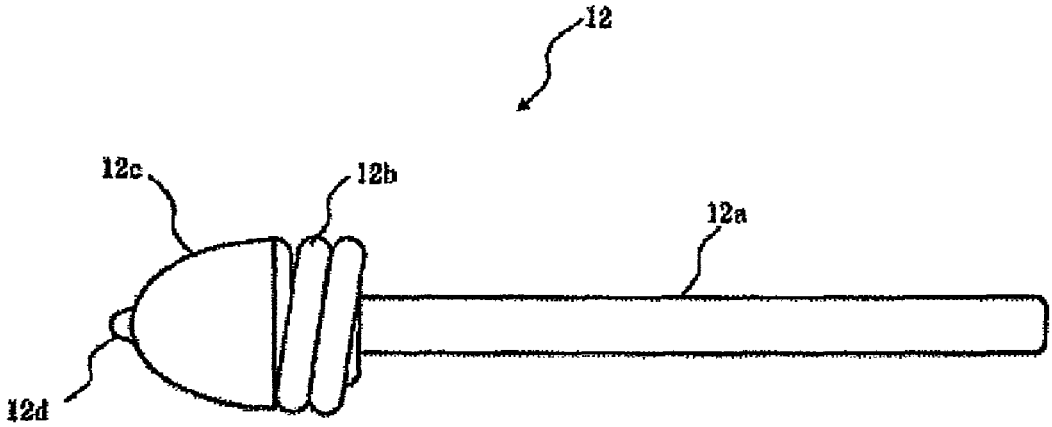
FIG. 5 shows forming the electrode tip (12*d*) by lighting the F electrode (12) according to an embodiment.
Figure 6:
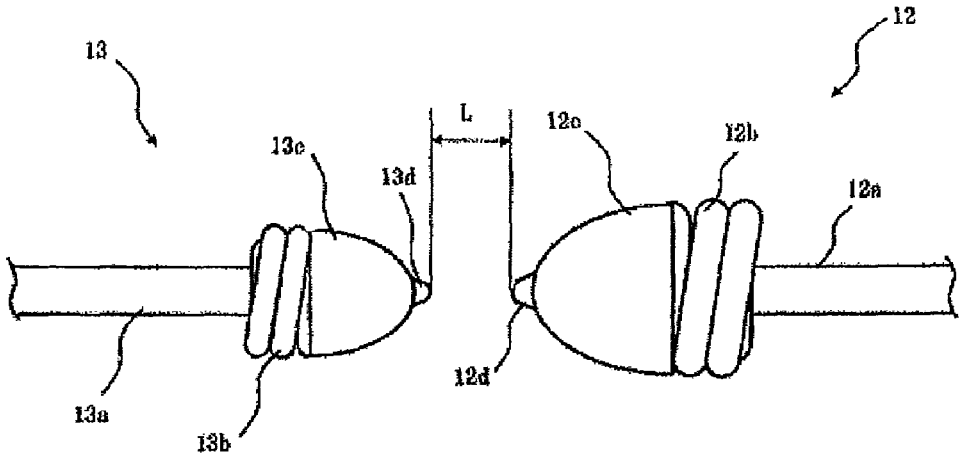
FIG. 6 shows the vicinity of the F electrode (12) and the R electrode (13) in the light discharge tube (1) according to an embodiment.
Figure 7:
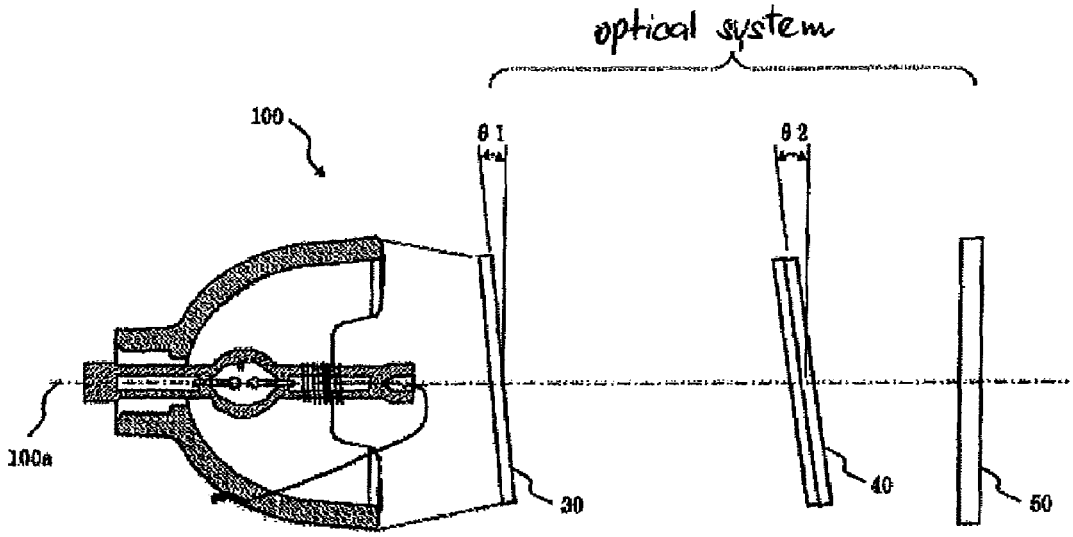
FIG. 7 is a conceptual view of the projector used in the simulation according to an embodiment.
Figure 8:
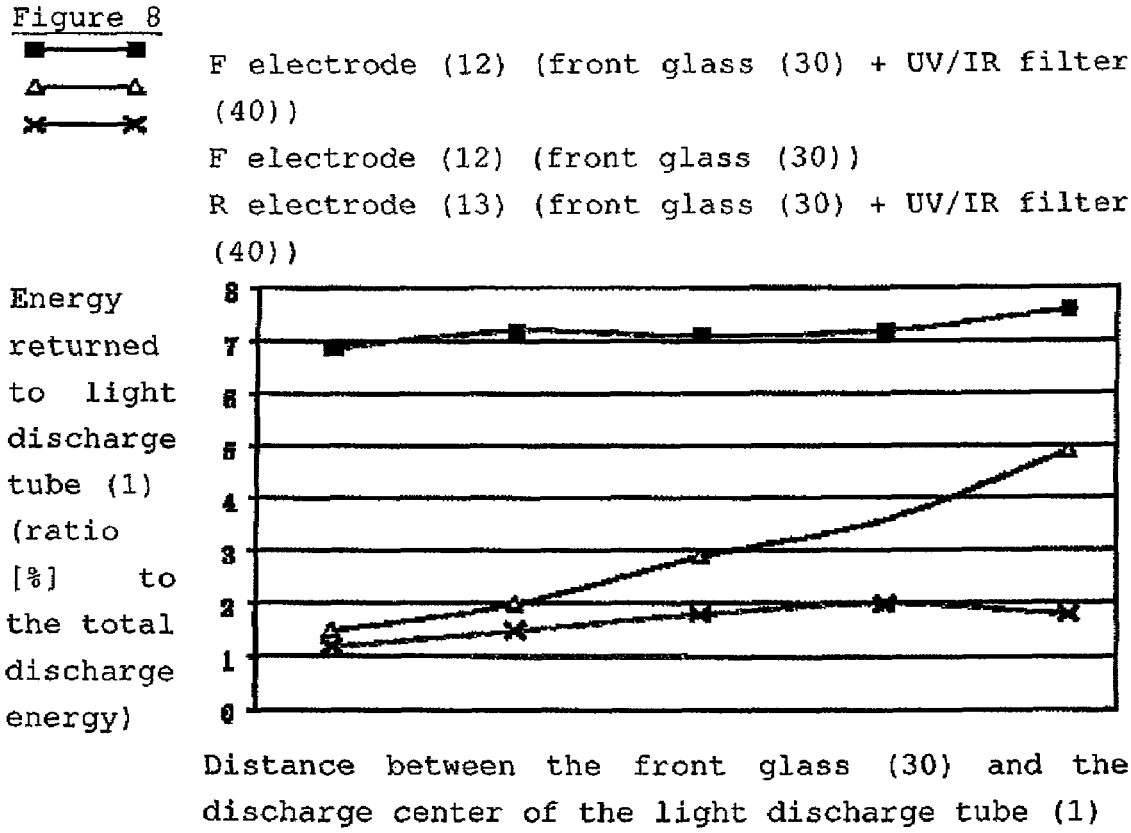
FIG. 8 shows the results of determining the energy returned to the light discharge tube (1) from the optical system primarily in the structure in FIG. 7 according to an embodiment.

FIG. 1 is a structural diagram of a discharge lamp with a reflective mirror (100). FIG. 2 is a structural diagram of the discharge lamp with a reflective mirror (100) showing the cross section with a part cut away. FIG. 3 shows the structure of the F electrode (12) in the initial period of the manufacturing process. FIG. 4 is the diagram in which the tip of the F electrode (12) is melted to form the melt electrode (12*c*). FIG. 5 is the diagram in which the F electrode (12) is lit and the electrode tip (12*d*) is formed. FIG. 6 shows the vicinity of the F electrode (12) and the R electrode (13) in the light discharge tube (1). FIG. 7 is a conceptual view of the structure of the projector used in the simulation. FIG. 8 shows the result of the energy from the optical system returned to the light discharge tube (1) primarily in the structure in FIG. 7.

The embodiment features the electrodes positioned inside of the light discharge tube (1). Therefore, the entire structure of the discharge lamp with a reflective mirror (100) is briefly explained.

The structure of the discharge lamp with a reflective mirror (100) is explained based on FIG. 1 and FIG. 2. The discharge lamp with a reflective mirror (100) is comprised of a light discharge tube (1), a ceramic ring (2) which holds the light discharge tube (1), an elliptical reflective mirror (3) (an example of the reflective mirror) which is fixed by the ceramic ring (2), and a cap (5) which is fixed to the back surface of the ceramic ring (2). The ceramic ring (2) holds the light discharge tube (1) near the R molybdenum foil (sealed part) of the light discharge tube (1). The reflective mirror may be a parabolic reflective mirror instead of the elliptical reflective mirror (3).

The light discharge tube (1) has an F electrode (12) welded to an F molybdenum foil (15) which is welded to an F lead wire (17), an R electrode (13) welded to an R molybdenum foil (16) which is welded to an R lead wire (18), and a roughly spherical light discharge part (11) sealing mercury (14) in the center (center part).

The elliptical reflective mirror (3) forms a portion of a rotational elliptical shape. The material of the elliptical reflective mirror (3) is glass.

The light discharge tube (1) positions the F electrode (12) on the opening part (3*a*) side and the R electrode (13) on the neck part (3*b*) side of the elliptical reflective mirror (3).

The structure incorporates the light discharge tube (1) in the elliptical reflective mirror (3) so that the center axis of the light discharge tube (1) is aligned to the center axis which connects the opening part (3*a*) and the neck part (3*b*) of the elliptical reflective mirror (3), and the center of the light discharge part (11) coincides with the focal point of the elliptical reflective mirror (3).

The ceramic ring (2) has a roughly cylindrical shape with an outer peripheral surface (2*a*) and an inner peripheral surface (2*b*). The ceramic ring (2) provides a fitting (22) which fits onto the edge on the side fixed to the elliptical reflective mirror (3) to cover the neck part (3*b*) of the elliptical reflective mirror (3).

The ceramic ring (2) provides a contact part (21) which places the edge in the axial direction of the neck part (3*b*) of the elliptical reflective mirror (3) in contact with the edge on the side fixed to the elliptical reflective mirror (3). The contact part (21) is roughly orthogonal to the direction of the center line of the light discharge tube (1).

The ceramic ring (2) is fixed to the elliptical reflective mirror (3) by cement (4*a*). The main component of the cement (4*a*) is silica.

Furthermore, the ceramic ring (2) provides a cut-out part (23) cut from the fitting (22) on the edge on the side fixed to the elliptical reflective mirror (3). The cut-out part (23) functions as a vent hole. In the discharge lamp with a reflective mirror (100), the cut-out part (23) is open in the state where the ceramic ring (2) is fixed to the elliptical reflective mirror (3). If the light discharge tube (1) explodes for some reason, a mesh (7) is provided on the cut-out part (23), as shown in FIG. 1, because of concern about glass fragments flying out through the cut-out part (23).

The assembly procedure of the discharge lamp with a reflective mirror (100) is briefly explained.

First, the ceramic ring (2) is fixed to the elliptical reflective mirror (3). The fitting (22) of the ceramic ring (2) is fitted onto the neck part (3*b*) of the elliptical reflective mirror (3) to cover the neck part (3*b*), and the contact part (21) of the ceramic ring (2) is placed in contact with the edge in the axial direction of the neck part (3*b*).

In this state, the elliptical reflective mirror (3) and the ceramic ring (2) are bonded by the cement (4*a*). The main component of the cement (4*a*) is silica.

Next, the light discharge tube (1) is inserted inside of the elliptical reflective mirror (3) and the ceramic ring (2). Then, while the light discharge tube (1) is lit, the position is adjusted in three dimensions in the light discharge tube (1) (referred to as the axis adjustment).

Thus, the center axis of the light discharge tube (1) is aligned with the center axis connecting the opening part (3*a*) and the neck part (3*b*) of the elliptical reflective mirror (3), and the center of the light discharge part (11) becomes the focal point of the elliptical reflective mirror (3).

Then, the cement (4*b*) is injected into the gap between the light discharge tube (1) and the inner peripheral surface (2*b*) of the ceramic ring (2) and dries (FIG. 2). Similar to cement (4*a*), cement (4*b*) has silica as the main component.

Furthermore, the light discharge tube (1) which projects from the ceramic ring (2) is cut off. The R lead wire (18) is not cut.

The R lead wire (18) and a trigger wire (9) are crimped by a crimping member (not shown, made of metal). The R lead wire (18) and the trigger wire (9) pass through the ring-shaped crimping member, and the ring-shaped crimping member appears to be crushed and crimped.

The crimping member which crimps the R lead wire (18) and the trigger wire (9) is welded to a first terminal (6).

The cap (5) covers the ceramic ring (2). There is a cut-off part (not shown) in the side wall of the cap (5), and the first terminal (6) is fitted in the cut-off part.

The F lead wire (17) on the opening part (3*a*) side of the elliptical reflective mirror (3) of the light discharge tube (1) is connected to a second terminal (31) installed on the outer peripheral surface of the elliptical reflective mirror (3).

The first terminal (6) and the second terminal (31) are connected to a power supply.

Next, the structures of the F electrode (12) and the R electrode (13) are explained. Although the sizes thereof differ, the basic structures of the F electrode (12) and the R electrode (13) are the same. Therefore, the F electrode (12) is explained.

As shown in FIG. 3, first, the F electrode (12) has a coil (12*b*) with the specified diameter and the specified number of windings wound on one end (side opposite the R electrode (13)) of a core wire (12*a*). The specified diameter and the specified number of windings of the coil (12*b*) are changed depending on the wattage of the lamp.

For example, the F electrode (12) shown in FIG. 3 is used in a 250 W lamp. If the wattage increases, the specified diameter and the specified number of windings of the coil (12*b*) increase.

The material of the core wire (12*a*) is tungsten. The diameter (d1*f*) of the core wire (12*a*) is approximately 0.5 mm.

The material of the coil (12*b*) is tungsten. The wire diameter (d2*f*) of the coil (12*b*) is approximately 0.25 to 0.3 mm.

The F electrode (12) (the same applies to the R electrode (13)) has the shape in FIG. 3, the part opposite the R electrode (13) is a smooth curved surface because the electrical discharge by the lamp is not stable. A melt electrode (12*c*) having a curved surface is formed on the tip of the F electrode (12).

The melt electrode (12*c*) is formed by a current flowing in the F electrode (12) and the R electrode (13) to melt the tungsten. The melting point of tungsten is approximately 3407° C.

The melt electrode (12*c*) may be formed before the F electrode (12) and the R electrode (13) are incorporated into the light discharge tube (1), or after the F electrode (12) and the R electrode (13) are incorporated into the light discharge tube (1).

Furthermore, after the lamp is completed, when aging (the lamp is lit), an electrode tip (12*d*) smaller than the melt electrode (12*c*) is formed on the tip of the melt electrode (12*c*) of the F electrode (12) (the same applies to the R electrode (13)).

The dimensions of the electrode tip (12*d*) are, for example, approximately 0.1 to 0.2 mm for the length in the axial direction and the maximum diameter.

The F electrode (12) and the R electrode (13) in this embodiment have shapes before forming the melt electrodes (12*c*, 13*c*) which satisfy any one of conditions (a) to (c) shown below or any combination of conditions (a) to (c) shown below:

(a) let the diameter of the core wire (12*a*) of the F electrode (12) be d1*f*, and the diameter of the core wire (13*a*) of the R electrode (13) be d1*r*, then 1) d1*f*>1.2×d1*r*

(b) let the wire diameter of the coil (12*b*) of the F electrode (12) be d2*f*, and the wire diameter of the coil (13*b*) of the R electrode (13) be d2*r*, then 2) d2*f*>1.2×d2*r*

(c) let the number of windings of the coil (12*b*) of the F electrode (12) be nf, and the number of windings of the coil (13*b*) of the R electrode (13) be nr, then 3) nf>1.2×nr As shown in FIG. 6, the size of the F electrode (12) is larger than the size of the R electrode (13) in the light discharge tube (1) when the F electrode (12) and the R electrode (13) satisfy any one of conditions (a) to (c) or any combination of conditions (a) to (c). Then the surface area of the F electrode (12) becomes larger than the surface area of the R electrode (13).

The distance L between the F electrode (12) and the R electrode (13) is, for example, approximately 1.0 mm. The dimensions of the electrode tip (12*d*) are, for example, approximately 0.1 to 0.2 mm for the length in the axial direction and the maximum diameter. Consequently, when the electrode tip (12*d*) of the F electrode (12) erodes, the distance L between the F electrode (12) and the R electrode (13) changes to approximately 1.1 to 1.2 mm By making the surface area of the F electrode (12) larger than the surface area of the R electrode (13), a temperature increase in the F electrode (12) on the opening part side of the elliptical reflective mirror (3) due to the reflected light from the optical system of the projector is suppressed. The resulting temperature difference between the two electrodes is smaller compared to the case of the same surface area of the F electrode (12) as the surface area of the R electrode (13); the halogen cycle functions normally; and the erosion of the F electrode (12) can be suppressed.

The halogen cycle refers to when the tungsten, which is the electrode material vaporized from the electrode, for example, returns to the electrode tip and maintains the electrode shape by increasing the electrode tip to the appropriate temperature by a current waveform in every cycle.

Next, the results of an examination of the energy of the reflected light returned from the optical system of the projector to the lamp by a simulation are presented.

FIG. 7 is a conceptual diagram of the structure of the projector used in the simulation. In FIG. 7, the discharge lamp with a reflective mirror (100) of the embodiment is held by a holder which provides the front glass (30) of the projector.

The front glass (30) is inclined at the angle θ1 with respect to the line orthogonal to the center wire (100*a*) of the discharge lamp with a reflective mirror (100). For example, the angle θ1 is no more than 10°. At the front glass (30), the light discharged from the light discharge tube (1) is fully transmitted (example).

A UV/IR filter (40) (ultraviolet light/infrared light filter) which reflects ultraviolet light and infrared light is provided in front of the front glass (30). The UV/IR filter (40) is inclined at the angle θ2 with respect to the line orthogonal to the center line (100*a*) of the discharge lamp with a reflective mirror (100). For example, the angle θ2 is 10°.

The UV/IR filter (40) is inclined at the angle θ2 because the ultraviolet light/infrared light returned from the UV/IR filter (40) misses the discharge lamp with a reflective mirror (100), and the energy returned to the light discharge tube (1) is smaller than when not inclined.

A color wheel (50) is provided in front of the UV/IR filter (40). The light is radiated forward from the color wheel (50). However, energy also returns from the color wheel (50).

FIG. 8 shows the results which determined the energy returned to the light discharge tube (1) from the optical system primarily in the structure in FIG. 7. The horizontal axis is the distance between the front glass (30) and the discharge center of the light discharge tube (1) (center between the F electrode (12) and the R electrode (13)). The vertical axis is the energy returned to the light discharge tube (1) (ratio [%] to the total discharge energy). The energy returned to the F electrode (12) and the R electrode (13) is determined for the structure in FIG. 7. In addition, for reference, the energy returned to the F electrode (12) is also determined when the UV/IR filter (40) is omitted from the structure in FIG. 7. However, this data is not particularly referred to below.

As is clear from FIG. 8, at the distance between the front glass (30) and the discharge center of the light discharge tube (1) usually adopted in a projector, in the structure in FIG. 7, (1) the energy returned to the F electrode (12) (ratio [%] to the total discharge energy) is approximately 6.5 to 8 [%];

(2) the energy returned to the R electrode (13) (ratio [%] to the total discharge energy) is approximately 1 to 2 [%].

Compared to the R electrode (13), the energy returned to the F electrode (12) is overwhelmingly large. Therefore, when the temperature of the F electrode (12) increases and a temperature difference is produced with the R electrode (13), sometimes, the electrode tip (12*d*) of the F electrode (12) erodes, and the lamp characteristics can no longer be maintained. In addition, the electrode shape deforms and an offset of the arc spot is produced by the erosion of the electrode tip (12*d*). For an AC discharge lamp with a reflective mirror (100), the spot offset in each cycle gives the impression of "flickering."

An example of the temperature data of the F electrode (12) and the R electrode (13) in the above simulation (structure in FIG. 7) is shown below.

(1) Temperature of the F electrode (12): approximately 2900° C.

(2) Temperature of the R electrode (13): approximately 2800° C.

A difference between the two of approximately 100° C. is seen. Although these are only reference data, an example of the temperature data of the F electrode (12) and the R electrode (13) when the discharge lamp with a reflective mirror (100) is removed from the projector, the data are as follows.

(1) Temperature of the F electrode (12): approximately 2815 to 2820° C.

(2) Temperature of the R electrode (13): approximately 2811 to 2817° C.

Almost no difference between the two is seen. Thus, the temperature increase of the F electrode (12) on the opening part side of the elliptical reflective mirror (3) by the reflected light from the optical system of the projector when the discharge lamp with a reflective mirror (100) is incorporated into the projector is understood. A temperature difference between the F electrode (12) and the R electrode (13) is produced, and the normal halogen cycle no longer functions. As a result, sometimes, the electrode tip (12*d*) of the F electrode (12) on the opening part side of the elliptical reflective mirror (3) erodes, and the lamp characteristics can no longer be maintained.

As described above, according to the embodiment, the shapes of the F electrode (12) and the R electrode (13) before forming the melt electrodes (12*c*,13*c*) satisfy any one of conditions (a) to (c) shown below or any combination of conditions (a) to (c) shown below:

(a) let the diameter of the core wire (12*a*) of the F electrode (12) be d1*f*, and the diameter of the core wire (13*a*) of the R electrode (13) be d1*r*, then 1) d1*f*>1.2×d1*r*

(b) let the wire diameter of the coil (12*b*) of the F electrode (12) be d2*f*, and the wire diameter of the coil (13*b*) of the R electrode (13) be d2*r*, then 2) d2*f*>1.2×d2*r*

(c) let the number of windings of the coil (12*b*) of the F electrode (12) be nf, and the number of windings of the coil (13*b*) of the R electrode (13) be nr, then 3) nf>1.2×nr From the above, the surface area of the F electrode (12) can be greater than the surface area of the R electrode (13), and the temperature increase of the F electrode (12) on the opening part side of the elliptical reflective mirror (3) caused by the reflected light from the optical system of the projector can be suppressed. Thus, the halogen cycle functions normally, and the lamp characteristics can be maintained.

The invention claimed is:

1. An Alternating Current (AC) discharge lamp comprising:

a light discharge tube having an interior chamber defining a light discharge part;

a first and second electrode within the light discharge part arranged to permit luminous electrical discharge therebetween and emission of light energy from the light discharge tube due to said electrical discharge during operation of said lamp; wherein, heat developed at the electrodes due to conditions external to said discharge lamp during operation of said lamp is dissipated respectively by said first electrode at a different respective rate than by said second wherein said lamp further comprises an optical system arranged to intercept at least a portion of the light energy emitted from the light discharge tube during operation of said lamp, the optical system comprising at least one optical element that returns at least a portion of said intercepted light energy back to the light discharge tube wherein said lamp further comprises:

a reflector having an opening part and a neck part opposite the opening part; and the reflector having a reflective interior surface for reflecting at least a portion of the light energy emitted from the light discharge tube toward said optical system; wherein, one of said first and second electrodes is a rear electrode located toward the neck part of the reflector, the rear electrode comprising a core wire extending through the light discharge part at a first end and having a coil wire wound around a second end of the core wire, the coil, the windings, forming a tip thereon, and the other of said first and second electrodes is a front electrode located toward the opening part of the reflector, the front electrode comprising a core wire extending through the light discharge part at a first end and having a coil wire wound around a second end of the core wire, the coil, the windings, forming a tip thereon; and wherein, said returned light energy is disproportional) absorbed by the front electrode wherein said difference in the respective electrode heat dissipation rates compensates for said disproportional absorption of returned light energy by the front electrode, whereby a temperature difference between the electrodes is minimized.

2. The AC discharge lamp according to claim 1, wherein said returned light energy is disproportionally absorbed by one of said first and second electrodes.

3. The AC discharge lamp according to claim 1, wherein said front electrode radiates heat away from its tip at a faster rate than the rear electrode.

4. The AC discharge lamp according to claim 1, wherein said front electrode has a larger surface area than said rear electrode.

5. The AC discharge lamp according to claim 1, wherein the diameter of the coil wire of the front electrode is greater than the diameter of the coil wire of the rear electrode.

6. The AC discharge lamp according to claim 1, wherein, during operation of said lamp, the front electrode conducts heat away from the front electrode tip at a faster rate than the rear electrode conducts heat away from the rear electrode tip.

7. The AC discharge lamp according to claim 1, wherein the diameter of the core wire of the front electrode is greater than the diameter of the core wire of the rear electrode.

8. The AC discharge lamp according to claim 4 wherein the number of windings of the coil wire forming the tip of the front electrode exceeds the number of windings of the coil wire forming the tip of the rear electrode.

9. An Alternating Current (AC) discharge lamp comprising:

a light discharge tube having an interior chamber defining a light discharge part;

a first and second electrode within the light discharge part arranged to permit luminous electrical discharge therebetween resulting in emission of light energy from the light discharge tube during operation of said lamp;

an optical element arranged to intercept at least a portion of the light energy emitted from the light discharge tube, the optical element returning at least a portion of said intercepted light energy back to the light discharge tube as returned energy; wherein, said returned energy is disproportionally absorbed by the first of said first and second electrodes thereby asymmetrically heating said electrodes; and wherein, the magnitude of at least one thermal characteristic of the first electrode is different from the magnitude of said at least one thermal characteristic of the second electrode, the difference in said magnitudes compensating for said asymmetry, thereby minimizing a temperature difference between the first and second electrodes during operation of said lamp.

10. The AC discharge lamp according to claim 9 wherein said optical element comprises a reflector having an opening part and a neck part opposite the opening part and having a reflective interior surface for reflecting at least a portion of the light energy emitted from the light discharge tube.

11. The AC discharge lamp according to claim 9 wherein said first electrode has a thermal mass greater than the thermal mass of said second electrode.

12. The AC discharge lamp according to claim 11 wherein said first electrode dissipates heat at a faster rate than said second electrode.

13. The AC discharge lamp according to claim 9 wherein said first electrode comprises a core wire having a first diameter, and a coil wire having a second diameter, the coil wire being wound around an end of the core wire, forming a tip thereon.

14. The AC discharge lamp according to claim 13 wherein the first electrode has a surface area greater than the surface area of the second electrode.

15. The AC discharge lamp according to claim 13, wherein the coil wire of said first electrode is melted around the end of the core wire of said first electrode to form a melt electrode having a curved surface.

16. The AC discharge lamp according to claim 15, wherein an electrode tip is formed on the melt electrode.

* * * * *